US009437358B2

(12) United States Patent
Kang et al.

(10) Patent No.: US 9,437,358 B2
(45) Date of Patent: Sep. 6, 2016

(54) SOFT MAGNETIC EXCHANGE-COUPLED COMPOSITE STRUCTURE, AND HIGH-FREQUENCY DEVICE COMPONENT, ANTENNA MODULE, AND MAGNETORESISTIVE DEVICE INCLUDING THE SOFT MAGNETIC EXCHANGE-COUPLED COMPOSITE STRUCTURE

(71) Applicant: Samsung Electronics Co., Ltd., Suwon-Si, Gyeonggi-Do (KR)

(72) Inventors: Young-min Kang, Yongin-si (KR); Kyung-han Ahn, Seoul (KR); Young-jae Kang, Hwaseong-si (KR); Sang-mock Lee, Yongin-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 157 days.

(21) Appl. No.: 14/146,274

(22) Filed: Jan. 2, 2014

(65) Prior Publication Data

US 2015/0024236 A1 Jan. 22, 2015

(30) Foreign Application Priority Data

Jul. 19, 2013 (KR) ..... 10-2013-0085692

(51) Int. Cl.

| | |
|---|---|
| ***H01F 1/11*** | (2006.01) |
| ***H01F 10/26*** | (2006.01) |
| ***C22C 29/12*** | (2006.01) |
| *H01F 1/34* | (2006.01) |
| *H01Q 7/06* | (2006.01) |

(52) U.S. Cl.

CPC ..... *H01F 10/265* (2013.01); *C22C 29/12* (2013.01); *C22C 2202/02* (2013.01); *H01F 1/11* (2013.01); *H01F 1/344* (2013.01); *H01F 1/346* (2013.01); *H01Q 7/06* (2013.01); *Y10T 428/12611* (2015.01); *Y10T 428/24975* (2015.01); *Y10T 428/265* (2015.01)

(58) Field of Classification Search

None

See application file for complete search history.

(56) References Cited

U.S. PATENT DOCUMENTS

| | | | |
|---|---|---|---|
| 4,425,401 | A | 1/1984 | Ido et al. |
| 4,565,726 | A | 1/1986 | Oguchi et al. |
| 4,578,313 | A | 3/1986 | Ito et al. |

(Continued)

FOREIGN PATENT DOCUMENTS

| | | |
|---|---|---|
| EP | 1340716 A1 | 9/2003 |
| JP | 09-251616 | 9/1997 |

(Continued)

OTHER PUBLICATIONS

Bercoff, et al., "High-Energy Ball Milling of Ba-Hexaferrite/Fe Magnetic Composite," *Journal of Magnestism and Magnetic Materials*, vol. 187, 1998, pp. 169-176.

*Primary Examiner* — Kevin Bernatz

(74) *Attorney, Agent, or Firm* — Harness, Dickey & Pierce, P.L.C.

(57) ABSTRACT

A soft magnetic exchange-coupled composite structure, and a high-frequency device component, an antenna module, and a magnetoresistive device including the soft magnetic exchange-coupled composite structure, include a ferrite crystal grain as a main phase and a soft magnetic metal thin film bound to the ferrite crystal grain by interfacial bonding on an atomic scale. A region of the soft magnetic metal thin film adjacent to an interface with the ferrite crystal grain includes a crystalline soft magnetic metal.

19 Claims, 11 Drawing Sheets

(56) References Cited

U.S. PATENT DOCUMENTS 4,618,537 A * 10/1986 Takano ..... G11B 5/722 360/134
4,675,170 A 6/1987 Hibst et al.
4,740,419 A 4/1988 Asai et al.
4,764,300 A 8/1988 Hibst et al.
4,880,666 A 11/1989 Ito et al.
5,032,931 A 7/1991 Suzuki et al.
5,055,322 A 10/1991 Yamamoto
5,059,469 A 10/1991 Hashimoto et al.
5,062,982 A 11/1991 Yamamoto et al.
5,062,983 A 11/1991 Yamamoto et al.
5,142,768 A * 9/1992 Aboaf ..... G11B 5/3106 29/603.12
5,209,970 A 5/1993 Ohlinger et al.
5,217,820 A 6/1993 Isshiki et al.
5,466,524 A 11/1995 Hoshi et al.
5,772,797 A * 6/1998 Nakanishi ..... G11B 5/147 148/306
5,866,028 A 2/1999 Toyota
5,976,713 A * 11/1999 Fuke ..... B82Y 10/00 324/252
6,139,766 A 10/2000 Taguchi et al.
6,194,058 B1 2/2001 Isobe et al.
6,402,980 B1 6/2002 Taguchi et al.
6,641,891 B2 11/2003 Doushita et al.
6,677,881 B1 1/2004 Okayama
6,783,889 B2 8/2004 Kubota et al.
6,791,803 B2 9/2004 Saito et al.
6,814,883 B2 11/2004 Marusawa
6,893,701 B2 5/2005 Noguchi et al.
7,501,194 B2 3/2009 Murayama et al.
7,758,706 B2 7/2010 Hirose et al.
8,945,628 B2 * 2/2015 Weissleder ..... A61K 9/5094 424/489
9,076,579 B2 * 7/2015 Hong ..... H01F 3/00
2002/0114977 A1 8/2002 Kubota et al.
2003/0017365 A1 1/2003 Doushita et al.
2003/0128453 A1 7/2003 Saito et al.
2004/0096703 A1 5/2004 Noguchi et al.
2009/0004475 A1 * 1/2009 Sadaka ..... H01F 1/24 428/403
2009/0098411 A1 4/2009 Nakagawa
2010/0060539 A1 * 3/2010 Suetsuna ..... H01F 1/33 343/787
2010/0215851 A1 * 8/2010 Shoji ..... B22F 1/0018 427/212
2012/0062435 A1 3/2012 Kato et al.
2012/0183811 A1 * 7/2012 Hattori ..... G11B 5/712 428/836
2013/0052483 A1 2/2013 Tahmasebi et al.
2014/0132376 A1 * 5/2014 Jin ..... C22C 38/10 335/302
2015/0024238 A1 * 1/2015 Kang ..... G11B 5/7325 428/831
2015/0097159 A1 * 4/2015 Apalkov ..... H01F 10/32 257/31

FOREIGN PATENT DOCUMENTS

JP 2002-109714 A 4/2002
JP 2004-079104 A 3/2004
JP 2004-247602 A 9/2004
JP 2006-241583 A 9/2006
JP 2007-176757 A 7/2007
JP 4904159 B2 3/2012
KR 100571119 B1 4/2006
KR 100704856 B1 4/2007
KR 20080082466 A 9/2008
KR 20120140183 A 12/2012
KR 10-1235842 B1 2/2013

* cited by examiner

SOFT MAGNETIC EXCHANGE-COUPLED COMPOSITE STRUCTURE, AND HIGH-FREQUENCY DEVICE COMPONENT, ANTENNA MODULE, AND MAGNETORESISTIVE DEVICE INCLUDING THE SOFT MAGNETIC EXCHANGE-COUPLED COMPOSITE STRUCTURE

CROSS-REFERENCE TO RELATED APPLICATION

This application claims the benefit of priority under 35 U.S.C. §119 from Korean Patent Application No. 10-2013-0085692, filed on Jul. 19, 2013 in the Korean Intellectual Property Office, the disclosure of which is incorporated herein by reference in its entirety.

BACKGROUND

1. Field

The present disclosure relates to soft magnetic exchange-coupled composite structures, and high-frequency device components, antenna modules, and magnetoresistive devices including the soft magnetic exchange-coupled composite structure.

2. Description of the Related Art

In recent years, due to the development of information and communication apparatuses such as a mobile phone and a personal computer, the development of high signal frequencies of devices is rapidly progressing, and accordingly there is a need for high-frequency electronic devices such as a filter and an inductor that are capable of operating in higher frequency than conventional electronic devices.

In order to develop high-frequency electronic devices, a magnetic material having a high saturation magnetization value, a high magnetic permeability, a low ferromagnetic resonance line width, and a small coercivity is desirable.

SUMMARY

Provided are soft magnetic exchange-coupled composite structures having an increased saturation magnetization value and a decreased coercivity.

Provided are high-frequency device components using the soft magnetic exchange-coupled composite structures.

Provided are antenna modules using the soft magnetic exchange-coupled composite structures.

Provided are magnetoresistive devices using the soft magnetic exchange-coupled composite structures.

According to some example embodiments, a soft magnetic exchange-coupled composite structure includes a ferrite crystal grain as a main phase; and a soft magnetic metal as an auxiliary phase bonded to the ferrite crystal grain by interfacial bon a crystalline soft magnetic metal thin film is in a region of the soft magnetic metal thin film adjacent to an interface with the ferrite crystal grain includes a crystalline soft magnetic metal.

The ferrite crystal grain may be at least one selected from the group consisting of hexagonal ferrite, spinel ferrite, and garnet ferrite.

The soft magnetic metal may be at least one selected from the group consisting of iron (Fe), cobalt (Co), nickel (Ni), manganese (Mn), and an alloy thereof.

The ferrite crystal grain may have a thin film structure or a particle structure.

The soft magnetic metal may have a thin film structure.

The soft magnetic metal may have a thin film structure, and a total thickness of the soft magnetic metal thin film bonded to the ferrite crystal grain by interfacial bonding on the atomic scale may be 1 nm or greater.

The ferrite crystal grain may have a thin film structure or a sheet structure, and a thickness of the ferrite crystal grain may be in a range of about 50 nm to about 500 nm.

The crystalline soft magnetic metal may have a thin film structure, and a total thickness of the soft magnetic metal may be 1 nm or greater.

A thickness of the soft magnetic metal may be in a range of about 1 nm to about 30 nm.

The soft magnetic exchange-coupled composite structure may further include a capping layer or a passivation layer.

The capping layer may include at least one selected from the group consisting of tantalum (Ta), chromium (Cr), titanium (Ti), nickel (Ni), tungsten (W), ruthenium (Ru), palladium (Pd), platinum (Pt), zirconium (Zr), hafnium (Hf), silver (Ag), gold (Au), aluminum (Al), antimony (Sb), molybdenum (Mo), cobalt (Co), and tellurium (Te).

The passivation layer may include at least one selected from the group consisting of aluminum oxide ($Al_2O_3$), magnesium oxide (MgO), titanium (Ti), aluminum (Al), and tantalum (Ta).

The ferrite crystal grain may have an M-type hexagonal ferrite crystal particle structure or an M-type hexagonal ferrite crystal grain thin film structure, and the soft magnetic material includes a Fe thin film or Fe-alloy thin film.

A total thickness of the Fe or Fe-alloy thin films may be 1 nm or greater.

A thickness of the M-type hexagonal ferrite crystal grain thin film may be in a range of about 60 nm to about 100 nm, and a thickness of the Fe or Fe-alloy thin films may be in a range of about 2 nm to about 20 nm.

The M-type hexagonal ferrite crystal grain particle or the M-type hexagonal ferrite crystal grain thin film may include $SrFe_{12}O_{19}$.

The soft magnetic exchange-coupled composite structure may further include a capping layer having at least one selected from the group consisting of tantalum (Ta), chromium (Cr), titanium (Ti), nickel (Ni), tungsten (W), ruthenium (Ru), palladium (Pd), platinum (Pt), zirconium (Zr), hafnium (Hf), silver (Ag), gold (Au), aluminum (Al), antimony (Sb), molybdenum (Mo), cobalt (Co), and tellurium (Te).

According to other example embodiments, a high-frequency device component includes the soft magnetic exchange-coupled composite structure.

According to yet other example embodiments, an antenna module includes the soft magnetic exchange-coupled composite structure.

According to further example embodiments, a magnetoresistive device includes the soft magnetic exchange-coupled composite structure.

BRIEF DESCRIPTION OF THE DRAWINGS

Example embodiments will be more clearly understood from the following detailed description taken in conjunction with the accompanying drawings. FIGS. 1-20 represent non-limiting, example embodiments as described herein.

FIGS. 1 to 3 are schematic views illustrating structures of soft magnetic exchange-coupled composite structures according to example embodiments;

FIG. 4 is a schematic view illustrating a circulator using a soft magnetic exchange-coupled composite structure according to example embodiments;

FIG. 5 is a schematic view illustrating a structure of a magnetic sheet using a soft magnetic exchange-coupled composite structure according to example embodiments;

FIG. 6 is a cross-sectional view illustrating a structure of a near field communication (NFC) sheet using a soft magnetic exchange-coupled composite structure according to example embodiments;

FIG. 7 is a schematic view illustrating an antenna module including the magnetic sheet of FIG. 5;

FIG. 8 is a cross-sectional view schematically illustrating a structure of an antenna module using a soft magnetic exchange-coupled composite structure according to example embodiments;

FIG. 10 is a schematic view illustrating a structure of a perpendicular magnetic recording medium using a soft magnetic exchange-coupled composite structure according to example embodiments;

FIG. 11 is a graph showing magnetization characteristics of a soft magnetic exchange-coupled composite structure of Example 1 and a structure of Comparative Example 1;

FIG. 12 is a graph showing magnetization characteristics of soft magnetic exchange-coupled composite structures of Examples 2 and 3 and a structure of Comparative Example 2;

FIG. 14 is a TEM image showing analysis results of the soft magnetic exchange-coupled composite structure of Comparative Example 1;

FIG. 15 is a graph showing magnetization characteristics according to a temperature in soft magnetic exchange-coupled composite structures of Examples 2 and 6 and the structure of Comparative Example 2;

FIGS. 17 and 18 are each a TEM-electron microscopy-energy dispersive X-ray analysis (EDAX) view and a graph showing analysis results of a soft magnetic exchange-coupled composite structure of Example 6; and FIGS. 19 and 20 are each a TEM-EDAX view and a graph showing analysis results of a soft magnetic exchange-coupled composite structures of Reference Example 1.

DETAILED DESCRIPTION

Figure 1:
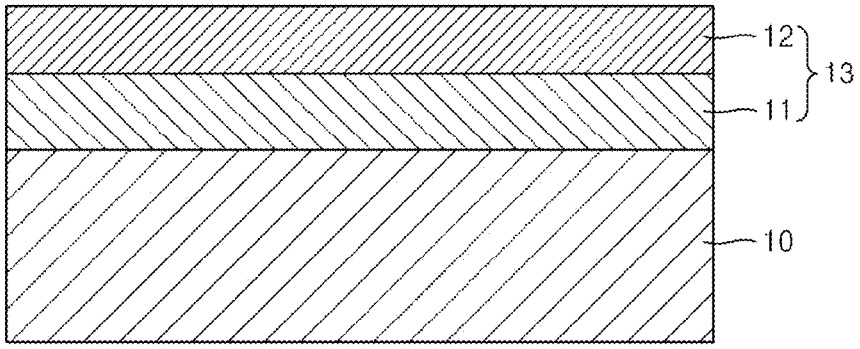

Various example embodiments will now be described more fully with reference to the accompanying drawings in which some example embodiments are shown. However, specific structural and functional details disclosed herein are merely representative for purposes of describing example embodiments. Thus, the invention may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope.

In the drawings, the thicknesses of layers and regions may be exaggerated for clarity, and like numbers refer to like elements throughout the description of the figures.

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing. For example, an implanted region illustrated as a rectangle may have rounded or curved features and/or a gradient (e.g., of implant concentration) at its edges rather than an abrupt change from an implanted region to a non-implanted region. Likewise, a buried region formed by implantation may result in some implantation in the region between the buried region and the surface through which the implantation may take place. Thus, the regions illustrated in the figures are schematic in nature and their shapes do not necessarily illustrate the actual shape of a region of a device and do not limit the scope.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In order to more specifically describe example embodiments, various features will be described in detail with reference to the attached drawings. However, example embodiments described are not limited thereto.

Hereinafter, example embodiments of one or more soft magnetic exchange-coupled composite structures, and/or high-frequency device components, antenna modules, and/or magnetoresistive device that using the soft magnetic exchange-coupled composite structures will be described in detail with respect to attached drawings.

According to some example embodiments, there is provided a soft magnetic exchange-coupled composite structure including a ferrite crystal grain as a main phase and a soft magnetic metal thin film as an auxiliary phase bound to the ferrite crystal grain by interfacial bonding on atomic scale, wherein a crystalline soft magnetic metal is in a region of the soft magnetic metal thin film adjacent to an interface with the ferrite crystal grain.

According to example embodiments, the crystalline soft magnetic metal may be in a crystalline region, a polycrystalline region or a mixed amorphous and crystalline region.

The soft magnetic exchange-coupled composite structure may include a ferrite crystal grain undergone soft magnetization by magnetic exchange coupling with a soft magnetic metal, and the soft magnetic metal.

Definitions of the terminologies "main phase", "auxiliary phase", and "interfacial bonding on atomic scale" used herein are as follows.

The terminology "main phase" refers to a phase that is thicker or more bulky than the "auxiliary phase".

The terminology "interfacial bonding on atomic scale" refers that a ferrite crystal grain as a main phase is directly bonded to a soft magnetic metal as an auxiliary phase by interfacial bonding on atomic scale, without an intermediate material or an interlayer therebetween.

A structure including a hard magnetic ferrite crystal grain as a main phase and a soft magnetic metal as an auxiliary phase generally and entirely has hard magnetic characteristics.

However, according to other example embodiments, the soft magnetic exchange-coupled composite structure includes the hard magnetic ferrite crystal grain that has undergone soft magnetization by magnetic exchange coupling with the soft magnetic metal. As a result, the ferrite crystal grain having greater coercivity than the soft magnetic metal may now have soft magnetic characteristics like the soft magnetic metal. That is, the soft magnetic exchange-coupled composite structure may include the ferrite crystal grain having an increased saturation magnetization value and a significantly decreased coercivity, and accordingly may reduce energy loss. In addition, unlike the existing hard magnetic ferrite crystal grain, the ferrite crystal grain used herein may improve thermal stability of the saturation magnetization.

The soft magnetic exchange-coupled composite structure may be applicable in a soft magnetic device or a high-frequency communication device component, which requires high magnetic permeability and low hysteresis.

The hard magnetic ferrite crystal grain may be in the form of particles or in the form of a thin film, and the soft magnetic metal may be in the form of a thin film.

According to some example embodiments, the soft magnetic metal and the ferrite crystal grain may be bound by interfacial bonding on an atomic scale while retaining their own separate particles. According to other example embodiments, the soft magnetic metal and the ferrite crystal grain may coexist as domains within a single grain.

A thickness of the soft magnetic metal thin film bound to the ferrite crystal grains by interfacial bonding on atomic scale is not particularly limited, but may be 1 nm or greater. In some example embodiments, the thickness may be in a range of about 1 to about 30 nm, for example, about 2 to about 20 nm, or about 2 to about 10 nm, and in some other embodiments of the present invention, may be 2 nm, 3 nm, 4 nm, 10 nm, or 20 nm.

According to another embodiment of the present invention, the ferrite crystal grain may be in the form of a thin film or a sheet, and may have a thickness in a range of about 50 to about 500 nm.

A thickness of the ferrite crystal grain thin film or the ferrite crystal grain sheet may be, for example, equal to or greater than a diameter of the ferrite crystal grain.

A thickness of the crystalline soft magnetic metal thin film that is in the region adjacent to the interface of the ferrite crystal grain may be 1 nm or greater for soft magnetization of the hard magnetic ferrite crystal grain. In some example embodiments, the thickness may be in a range of about 1 nm to about 30 nm, for example, about 2 nm to about 20 nm, or about 2 nm to about 10 nm. In this regard, the hard magnetic ferrite crystal grain may be, for example, in the form of a thin film.

A thickness of the hard magnetic ferrite crystal grain thin film or a diameter of the hard magnetic ferrite crystal grain that undergoes soft magnetization by the soft magnetic metal thin film may be in a range of about 50 to about 500 nm, and in some example embodiments, may be in a range of about 50 nm to about 100 nm. In some other example embodiments, the thickness may be in a range of about 60 to about 100 nm. When the hard magnetic ferrite crystal grain thin film or the hard magnetic ferrite crystal grain has a thickness or a diameter within these ranges, the soft magnetic exchange-coupled composite structure may have good soft magnetic characteristics.

According to other example embodiments, a thickness ratio of the hard ferrite crystal grain thin film to the soft magnetic metal thin film may be in a range of about 4:1 to about 40:1. When the thickness ratio is within this range, the soft magnetic exchange-coupled composite structure may have good soft magnetic characteristics.

The bonding of the crystalline soft magnetic metal thin film to the hard magnetic ferrite crystal grain by interfacial bonding on an atomic scale may be confirmed by transmission electron microscopy (TEM).

In some example embodiments, a soft magnetic metal of a soft magnetic metal thin film located a distance away from the interface with the hard magnetic ferrite crystal grain, not directly adjacent thereto, may have a crystalline structure.

The configuration of the interface between the soft magnetic metal and the hard magnetic ferrite crystal grain is not limited. For example, the interface between the soft magnetic metal and the hard magnetic ferrite crystal grain may be non-coplanar. As another example, the interface with the hard magnetic ferrite crystal grain may be formed along sidewalls of the soft magnetic metal.

The hard magnetic ferrite crystal grain may be a hexagonal ferrite crystal grain including a phase such as an M-type, an U-type, a W-type, an X-type, an Y-type, or a Z-type.

The hard magnetic ferrite crystal grain may have a hexaferrite material having a hexagonal crystalline structure. The hexaferrite material may be, for example, an M-type hexaferrite (e.g., $AFe_{12}O_{19}$, where A is Ba, Sr, Ca, and Pb, or a mixture thereof) or a W-type hexaferrite (e.g., $AM_2Fe_{16}O_{27}$, where A is Ba, Sr, Ca, and Pb, or a mixture thereof, and M is Co, Ni, Cu, Mg, Mn, or Zn).

The hard magnetic ferrite crystal grain may be spinel ferrite ($MeFe_2O_4$) having a cubic crystalline structure (where Me is at least one transition metal selected from Mn, Zn, Co, and Ni), or may be garnet ferrite ($Y_3Fe_5O_1$, where Y is yttrium or a rare earth element).

For example, the spinel ferrite may be $MnZnFe_2O_4$ and $NiZnFe_2O_4$.

Any metal having soft magnetic characteristics may be used as a soft magnetic metal. The soft magnetic metal may be at least one selected from iron (Fe), cobalt (Co), nickel (Ni), and manganese (Mn), or an alloy thereof.

According to example embodiments, the soft magnetic metal may be Fe or a Fe-alloy.

According to example embodiments, the soft magnetic metal exchange-coupled composite structure may further include a capping layer to prevent oxidation of the soft magnetic metal. For example, the capping layer may include at least one layer.

The capping layer may include at least one selected from tantalum (Ta), chromium (Cr), titanium (Ti), nickel (Ni), tungsten (W), ruthenium (Ru), palladium (Pd), platinum (Pt), zirconium (Zr), hafnium (Hf), silver (Ag), gold (Au), aluminum (Al), antimony (Sb), molybdenum (Mo), cobalt (Co), and tellurium (Te). A thickness of the capping layer is not particularly limited, but may be in a range of about 1 nm to about 50 nm.

According to example embodiments, the soft magnetic exchange-coupled composite structure may further include a passivation layer. For example, the passivation layer may include at least one layer.

The passivation layer may prevent oxidation of internal soft magnetic metal layers to protect the same. The passivation layer may include, for example, at least one selected from the group consisting of aluminum oxide ($Al_2O_3$), magnesium oxide (MgO), Ti, Al, and Ta.

According to example embodiments, the soft magnetic exchange-coupled composite structure may include an M-type hexagonal ferrite crystal grain having a thickness in a range about 50 nm to about 500 nm, for example, about 60 nm to about 100 nm. In some example embodiments, the soft magnetic exchange-coupled composite structure may include a Fe or a Fe-alloy thin film having a thickness in a range of about 1 nm to about 30 nm, for example, about 2 nm to about 20 nm. When the thickness is within these ranges, the soft magnetic exchange-coupled composite structure may have good soft magnetic characteristics.

According to example embodiments, there is provided a hard magnetic exchange-coupled composite structure that includes a ferrite crystal grain as a main phase and a soft magnetic metal thin film as an auxiliary phase bound to the ferrite crystal grain by interfacial bonding on an atomic scale, wherein an amorphous soft magnetic metal thin film having a thickness of about 5 nm or less is in a region adjacent to an interface with the ferrite crystal grain.

According to example embodiments, a total thickness of the soft magnetic metal thin films bound on top of the ferrite crystal grains may be 1 nm or greater, for example in a range of about 1 to about 30 nm. In some example embodiments, a soft magnetic metal thin film in a far distance away from the interface with the ferrite crystal grain, not directly adjacent thereto, may have an amorphous structure or a crystalline structure.

When a soft magnetic metal layer in a region adjacent to the interface with the ferrite crystal grain has an amorphous structure or when an interlayer is disposed between the ferrite crystal grain and the soft magnetic metal layer, the occurrence of soft magnetization of the ferrite crystal grain may be significantly reduced or may hardly happen. Here, a thickness of the amorphous soft magnetic metal layer in the region adjacent to the interface with the ferrite crystal may be 5 nm or less, and in some example embodiments, may be in a range of about 0.1 nm to about 5 nm, for example, about 0.1 nm to about 2 nm, or about 0.5 nm to about 1 nm.

According to example embodiments, the amorphous structure may be a main phase of the soft magnetic layer, and the crystalline soft magnetic metal thin film that is in the region adjacent to the interface of the ferrite crystal grain may be an auxiliary phase. According to other example embodiments, the crystalline soft magnetic metal thin film that is in the region adjacent to the interface of the ferrite crystal grain may be a main phase, and the amorphous structure may be an auxiliary phase.

According to example embodiments, in the hard magnetic exchange-coupled composite structure, hard magnetic exchange coupling occurs between the ferrite crystal grain and the soft magnetic metal of the soft magnetic metal thin film, so that the soft magnetic metal thin film as the auxiliary phase may comply with (or, exhibit) magnetization behavior of the hard magnetic ferrite crystal grain as the main phase. As a result, the hard magnetic exchange-coupled composite structure may retain not only a high saturation magnetization value of the soft magnetic metal, but also a low coercivity as much as the hard magnetic ferrite crystal grain, to thereby significantly improve hard magnetic characteristics. Therefore, the hard magnetic exchange-coupled composite structure may have improved magnetic characteristics compared to existing hard magnetic ferrite materials, and may be applicable in a perpendicular magnetic recording medium or a permanent magnetic device of a magnetic circuit using hard magnetic materials. Consequently, the perpendicular magnetic recording medium or the permanent magnetic device of a magnetic circuit may also have significantly improved magnetic performance.

FIG. 1 is a schematic view illustrating a structure of a soft magnetic exchange-coupled composite structure according to example embodiments.

Referring to FIG. 1, a soft magnetic exchange-coupled composite structure 13 includes a ferrite crystal grain thin film 11 as a main phase disposed on a substrate 10, and a soft magnetic metal thin film 12 as an auxiliary phase disposed on the ferrite crystal grain thin film 11. A crystalline soft magnetic metal thin film is present in a region adjacent to an interface with the hard magnetic ferrite crystal thin film 11.

Any substrate able to support the ferrite crystal grain thin film 11 may be used as the substrate 10. Examples of the substrate 10 are Si, $SiO_2$/Si, Sapphire, $SrTiO_3$, $LaAlO_3$, and MgO substrates.

Figure 2:
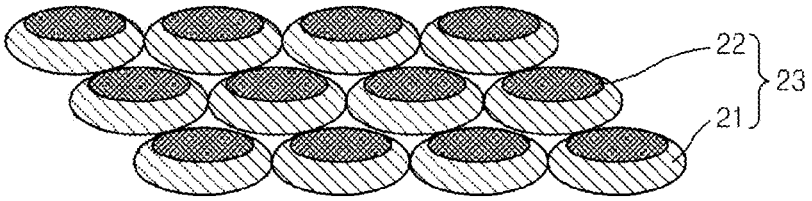
Figure 3:
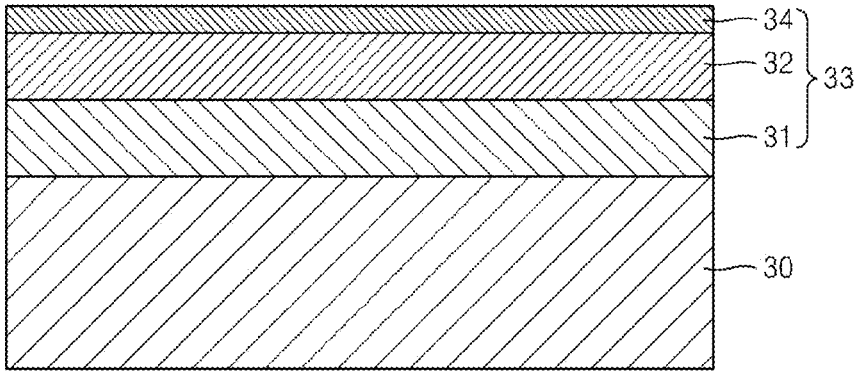

FIGS. 2 and 3 are schematic views illustrating structures of soft magnetic exchange-coupled composite structures according to example embodiments.

Referring to FIG. 2, a soft magnetic exchange-coupled composite structure 23 includes a soft magnetic metal thin film 22 disposed on hard ferrite crystal grain particles 21. A crystalline soft magnetic metal thin film is in a region adjacent to the interface of the hard magnetic ferrite crystal grain particles 21.

Referring to FIG. 3, a soft magnetic exchange-coupled composite structure 33 sequentially includes a substrate 30, a ferrite crystal thin film 31, and a soft magnetic metal thin film 32. A capping layer 34 is disposed on the soft magnetic metal thin film 32 to prevent oxidation of the soft magnetic metal of the soft magnetic metal thin film 32. The soft magnetic exchange-coupled composite structure of FIG. 2 may also further include a capping layer on the soft magnetic metal thin film 22, like the soft magnetic exchange-coupled composite structure of FIG. 3.

The soft magnetic exchange-coupled composite structure may include M-type hexagonal ferrite crystal grain particles or an M-type hexagonal ferrite crystal grain thin film, and a Fe or Fe-alloy thin film.

According to example embodiments, a total thickness of the Fe or Fe-alloy thin films may be in a range of about 1 nm to about 30 nm, for example, about 1 nm to about 20 nm.

A thickness of the M-type hexagonal ferrite crystal grain thin film may be in a range of about 50 nm to about 100 nm, that of the Fe or Fe-alloy thin film may be in a range of about 1 nm to about 30 nm, for example, about 2 nm to about 10 nm, and that of a crystalline Fe or Fe-alloy thin film present in the region adjacent to the interface with the M-type hexagonal ferrite crystal grain thin film may be 2 nm or less, for example, in a range of about 0.1 nm to about 2 nm.

The M-type hexagonal ferrite crystal grain particles or the M-type hexagonal ferrite crystal grin thin film may include $SrFe_{12}O_{19}$.

Hereinafter, a method of preparing a soft magnetic exchange-coupled composite structure according to the above-described example embodiments will be described.

A hard magnetic ferrite crystal grain thin film or hard magnetic ferrite crystal grain particles are formed on a substrate by using hard magnetic ferrites. Here, any method of forming the hard magnetic ferrite crystal grain thin film or hard magnetic ferrite crystal grain particles known in the art may be used.

The hard magnetic ferrite crystal grain thin film may be formed by, for example, deposition, coating, or the like.

The deposition may be physical-chemical vapor deposition.

The physical-chemical vapor deposition may be sputtering, pulsed laser deposition (PLD), molecular beam epitaxy (MBE), ion plating or ion beam deposition.

In some example embodiments, the hard magnetic ferrite crystal grain thin film or hard magnetic ferrite crystal grain particles may be deposited by PLD. This will be described below in greater detail.

First, a target as a bulk sintered body may be manufactured using hard magnetic ferrite crystal grains by, for example, a solid state process.

The obtained target may be deposited on a substrate by PLD, and then thermally treated to form a hard magnetic ferrite crystalline thin film or hard magnetic ferrite crystal grain particles.

The thermal treatment may be performed in an air or oxygen atmosphere at a temperature in a range of about 800° C. to about 1,100° C. When the temperature of the thermal treatment is within this range, a hard magnetic ferrite crystal grain thin film or hard magnetic ferrite crystal grain particles having good performance may be obtained.

Then, a soft magnetic metal thin film may be formed on the hard magnetic ferrite crystal grain thin film or hard magnetic ferrite crystal grain particles.

The soft magnetic metal thin film may be formed by deposition, deep coating, spray coating, atomization, or the like. For example, the soft magnetic metal thin film may be formed by deposition, like the hard magnetic ferrite crystal grain thin film. In some other example embodiments, the soft magnetic metal thin film may be formed by deep coating in which hard ferrite crystal grain particles are added to a solution from which soft magnetic metals may be precipitated, or by atomization or spray coating.

The deposition of the soft magnetic metal thin film on the hard magnetic ferrite crystal grain film or the hard magnetic ferrite crystal grain particles may be thermally treated in vacuum at room temperature (between 20° C. to 25° C.) or at a temperature in a range of about 200° C. to about 600° C.

When the deposition of the soft magnetic metal thin film on the hard magnetic ferrite crystal grain film or the hard magnetic ferrite crystal grain particles is performed at room temperature (between 20° C. to 25° C.), the deposition may include an additional thermal treatment in a vacuum. In regard to conditions of the thermal treatment in a vacuum, the vacuum pressure may be in range of about $1\times10^{-8}$ to about $1\times10^{-5}$ Torr, for example, about $1\times10^{-7}$ to about $2\times10^{-8}$ Torr, and a temperature of the thermal treatment may be in a range of about 200° C. to about 600° C. When the conditions are within the above ranges, oxidation of the soft magnetic metal of the soft magnetic metal thin film may be prevented, thereby obtaining a composite structure having good soft magnetic characteristics.

After the thermal treatment in a vacuum, a soft magnetic exchange-coupled composite structure having a crystalline soft magnetic metal thin film in a region adjacent to an interface with the hard magnetic ferrite crystal grains may be formed.

When a temperature of the thermal treatment in a vacuum is between about 300° C. and 600° C., the soft magnetic metal (e.g., Fe) of the soft magnetic metal thin film may be grown to increase a thickness of the soft magnetic metal thin film. For example, when a Fe thin film having a thickness of about 2 nm is thermally treated in vacuum at a temperature between 300° C. and 600° C., a thickness of the Fe thin film may exceed about 2 nm, and may be, for example, about 20 nm.

Although the hard ferrite crystal grains are thermally treated, a reduction reaction thereof may not occur in general.

When the thermal treatment in a vacuum is performed within the above temperature range, the soft magnetic metal thin film (e.g., Fe thin film) may be a seed layer to proceed (or, initiate) a reduction reaction of the hard magnetic ferrite crystal grains, and accordingly an oxygen amount of the hard magnetic ferrite crystal grains may be reduced. That is, when the soft magnetic exchange-coupled composite structure includes oxygen-deficient hard magnetic ferrite crystal grains, a coercivity of the soft magnetic exchange-coupled composite structure may be decreased, but a saturation magnetization value thereof may be increased. As a result, the soft magnetic exchange-coupled composite structure may further improve soft magnetic characteristics.

When the deposition of the soft magnetic metal thin film on the hard magnetic ferrite crystal grain to a thickness of 5 nm or less, for example, in a range of about 1 nm to about 5 nm at room temperature is performed without carrying out the thermal treatment in a vacuum, a hard magnetic exchange-coupled composite structure including a hard magnetic ferrite crystal grain and a soft magnetic metal thin film bound to the ferrite crystal grain by interfacial bonding on an atomic scale and having a thickness of about 5 nm or less, for example, in a range of about 1 nm to about 5 nm may be provided, wherein an amorphous soft magnetic metal thin film is in a region adjacent to an interface with the ferrite crystal grain.

In some example embodiments, the soft magnetic metal thin film may be formed by sputtering.

The sputtering may be performed in an inert gas atmosphere at a sputtering pressure in a range of about 0.5 mTorr to about 5 mTorr. The inert gas may be an argon gas or a nitrogen gas.

In regard to the sputtering conditions, a sputtering power may be in a range of about 20 W to about 50 W, and a distance between a sputtering target and the substrate may be in a range of about 10 cm to about 50 cm. The sputtering may be performed for about 100 minutes to about 1,000 minutes.

When the sputtering conditions are within the above ranges, a soft magnetic metal thin film having good performance may be formed.

After performing the above-described sputtering, the soft magnetic exchange-coupled composite structure may further include a thermal treatment in a vacuum at a temperature in a range of about 200° C. to about 600° C., for example, about 300° C. to about 400° C., and a vacuum pressure in a range of about $1\times10^{-8}$ Torr to about $1\times10^{-8}$ Torr, for example, about $1\times10^{-7}$ Torr to about $2\times10^{-8}$ Torr.

According to example embodiments, there is provided a high-frequency device component using a soft magnetic exchange-coupled composite structure prepared according to example embodiments.

In the high-frequency device component, a signal input from a select (or, pre-determined) port is rotated in one direction according to Faraday rotation, and then transferred to an another select (or, pre-determined) port. For example, the high-frequency device component may be a circulator or an isolator.

The circulator may have three ports. Signals input from each of the three ports may have the same transfer coefficient and reflection coefficient to each other, and may be transferred from one port to an another adjacent port. Therefore, each of the three ports may be simultaneously an input port and an output port having directivity with respect to adjacent ports.

The isolator may have three ports, and one of them may be connected to a terminating resistance to enable each port to perform one function only. That is, signals input from an input port may be transferred to an output port, and signals input from an output port may be transferred to a termination port that is connected to the terminating resistance, and then dissipated. In case of an ideal isolator, a transfer of signals from an outer port to an input port may be blocked.

In regard to a transmitting end of a wireless communication device, the isolator or the circulator may be positioned between a power amplifier and an antenna. Thus, the isolator or the circulator may help amplified signals transferred from the power amplifier to the antenna with little loss. Also, the isolator or the circulator may help unwanted signals or reflected signals back from the antenna blocked from the power amplifier.

Figure 4:
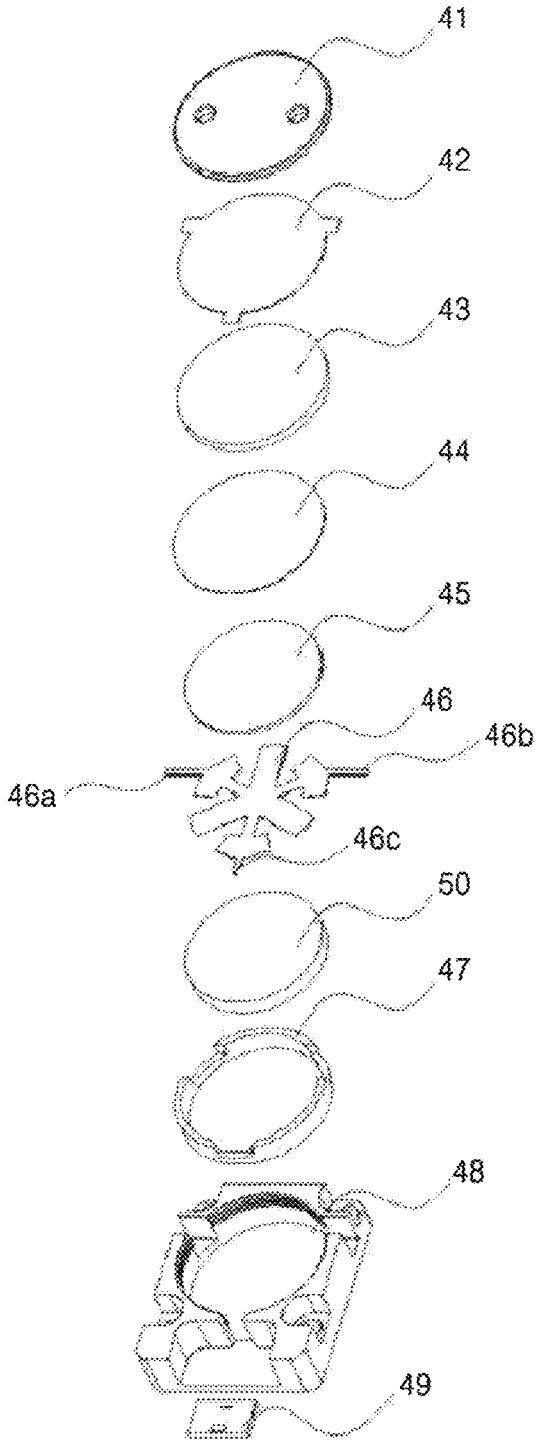

FIG. 4 is a schematic view illustrating a circulator according to example embodiments.

Referring to FIG. 4, a circulator includes a stripline center conductor 46, a soft magnetic exchange-coupled composite structure 45 prepared according to example embodiments, a pole piece 44, a permanent magnet 43, and a return pole piece 42 that are included in a housing 48. The housing 48 may be prepared by machining metal blocks. Three leads 46*a*, 46*b*, and 46*c* of the center conductor 46 compose three ports of the center conductor 46, respectively, and three openings are formed on the side wall surface of the housing 48 to allow the leads 46*a*, 46*b*, and 46*c* to protrude (or, extend) outside the center conductor 46. The housing 48 including the above-described device components is assembled with a lid 41 to compressively fix the device components inside the housing 48. In this regard, screw threads in the form of a columnar soil structure may be provided on an internal diameter of the housing 28 and on an outer diameter of the lid 41, and thus may be assembled interlocked. Therefore, as the lid 41 is coupled to the housing 48 along the screw threads on the internal diameter of the housing 48, the device components stacked inside the housing 48 are tightly compressed together. Here, the housing 48 and the lid 41 may be formed of soft magnetic materials. That is, the housing 48 and the lid 41 may help a magnetic field that is generated by the permanent magnet 44 had a low magnetic reluctance and flew in the form of a magnetic closed loop without losing a static magnetic field.

In some example embodiments, the soft magnetic exchange-coupled composite structure may be applicable in a magnetic sheet and an NFC sheet that are used in an antenna module.

Figure 5:
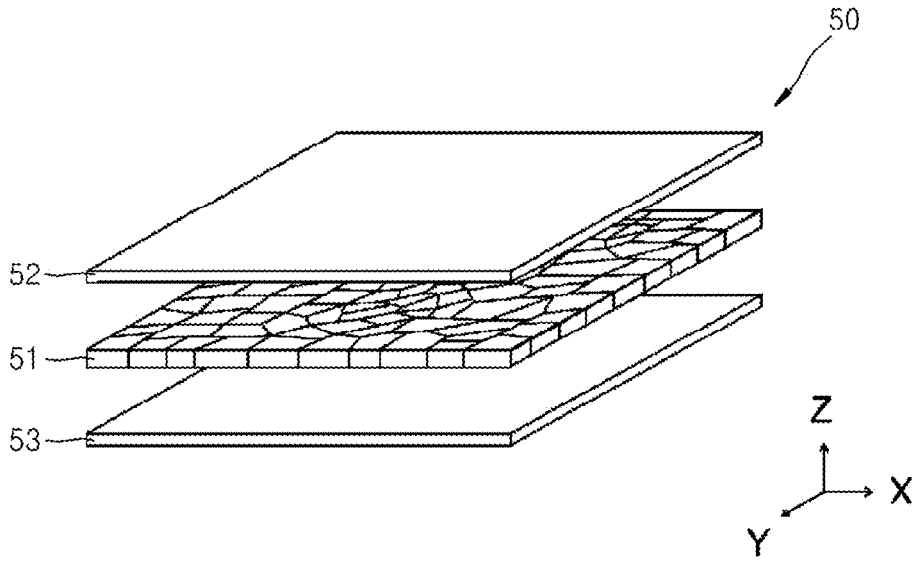

FIG. 5 is an exploded perspective view illustrating a magnetic sheet according to example embodiments.

Referring to FIG. 5, a magnetic sheet 50 includes a soft magnetic exchange-coupled composite structure 51 disposed between a first protective layer 52 and a second protective layer 53. A shape of the magnetic sheet 50 of FIG. 5 is a square shape, but example embodiments are not limited thereto.

The first protective layer 52 may be attached to one side of the soft magnetic exchange-coupled composite structure 51 to protect and support the same. The first protective layer 52 may be formed of flexible materials, polymeric materials such as polyethyleneterephthalate (PET), acrylic resin, teflon, and polyimide, papers, one-side adhesive agents, double-sided adhesive agents, or the like. Alternatively, the first protective layer 52 may be a flexible print substrate.

The second protective layer 53 may be attached to the other side soft magnetic exchange-coupled composite structure 51 such that the second protective layer 53 may be opposite to the first protective layer 52. The second protective layer 53 is attached to the magnetic exchange-coupled composite structure 51 to protect and support the same. The second protective layer 53 may be formed of the same materials as described in conjunction with the first protective layer 52. However, the materials used to form the first protective layer 52 may be identical to, or different from, those used to form the second protective layer 53.

Figure 7:
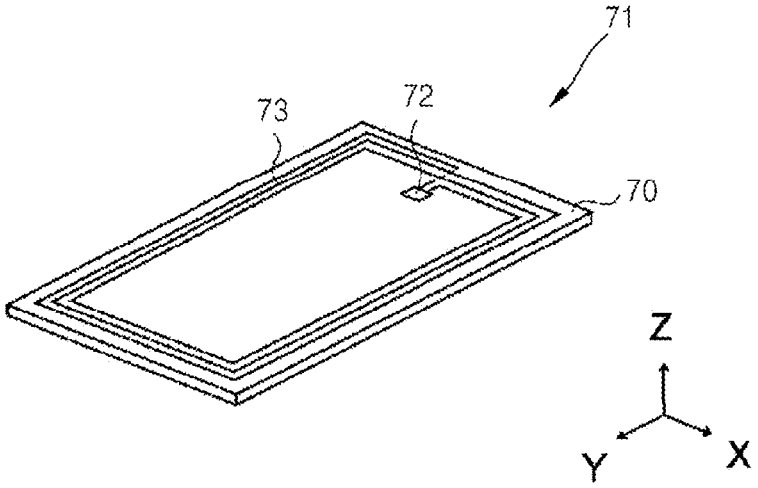

Referring to FIG. 7, a magnetic sheet is modulated with an antenna coil o provide an antenna module.

Referring FIG. 7, an antenna module 71 may be applicable in a radio frequency (RF) communication device, a radio frequency identification (RFID) system, a noncontact power-supplying system or the like. Here, the antenna module 71 is considered being applicable in the RFID system. However, the antenna module 71 is not limited thereto as long as a magnetic sheet 70 and an antenna coil 73 are integrally modulated in the antenna module 71.

Referring to FIG. 7, the antenna module 71 includes the magnetic sheet 70, the antenna coil 73 disposed on the magnetic sheet 70, and an integrated circuit (IC) chip 72 that is connected to the antenna coil 73. The antenna coil 73 and the IC chip 72 may be for example, adhered to each other and then disposed on the magnetic sheet 70. The antenna coil 73 may be a coil-type wire wound like a jelly roll, and a shape and a number of winding of the antenna coil 73 are not limited. The IC chip 72 may be connected to both ends of the antenna coil 73. In the RFID system, due to incident electromagnetic waves on the antenna module 71, induced electromotive force may be generated in the antenna coil 73, and then supplied to the IC chip 72. That is, the IC chip 72 may be operated by the induced electromotive force and keep information from the incident electromagnetic waves (carrier waves) of the antenna coil 73. Alternatively, the information recorded in the IC chip 72 may be output in the form of the carrier waves to the antenna coil 73. A size of the magnetic sheet 70 with respect to the antenna coil 73 is not particularly limited. However, in consideration of a function of the magnetic sheet 70, that is, the function of preventing magnetic field components that are produced by the antenna module 71 from interfering (or binding) metals around the antennal module 71, the magnetic sheet 70 may be appropriately spread throughout the antenna coil 73.

Figure 6:
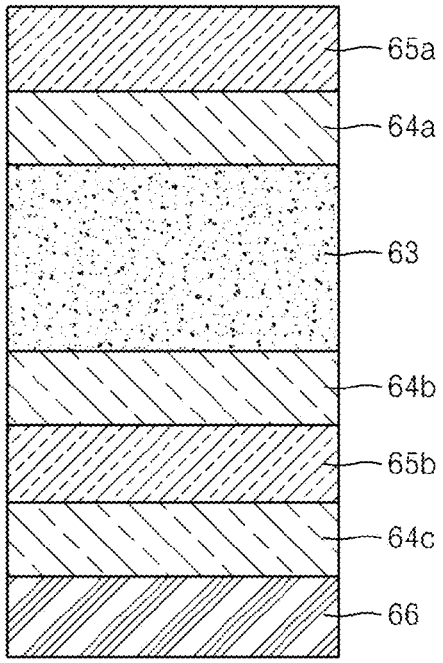

FIG. 6 is a cross-sectional view illustrating a structure of an NFC sheet using a soft magnetic exchange-coupled composite structure according to example embodiments.

Referring FIG. 6, the NFC sheet includes an adhesive layer 64*a* and a PET film 65*a* that are sequentially stacked on one surface of a soft magnetic exchange-coupled composite structure 63. Also, an another adhesive layer 64*b* and an another PET film 65*b* are sequentially stacked on the other surface of the soft magnetic exchange-coupled composite structure 63. An another adhesive layer 64*c* and a separator 66 are sequentially stacked on the PET film 65*b*.

Figure 8:
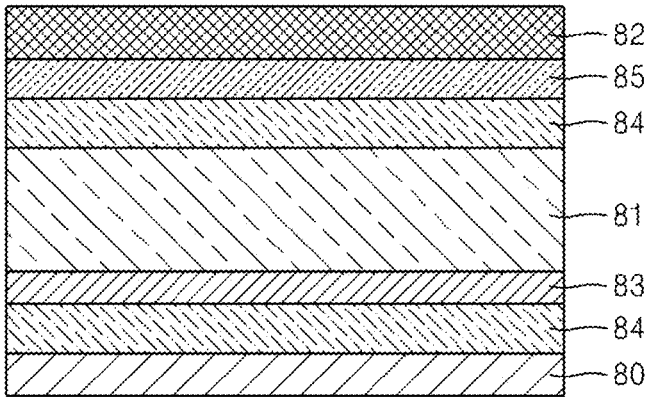

FIG. 8 is a cross-sectional view schematically illustrating a structure of an antenna module according to example embodiments.

Referring to FIG. 8, an antenna module includes a conductive loop antenna 85 disposed on one surface of a soft magnetic exchange-coupled composite structure 81 as a magnetic member, and a conductive layer 83 disposed on the other surface of the soft magnetic exchange-coupled composite structure 81. Here, the conductive loop antenna 85 may form a swirl-typed conductive loop having a thickness in a range of about 20 μm to about 30 μm on one surface of an insulating film having a thickness in a range of about 20 μm to about 60 μm. The insulating film may be a polyimide film and a PET film.

A thickness of the conductive layer 83 may be in a range of about 5 μm to about 50 μm. A double-sided adhesive tape 84 is adhered between the conductive loop antenna 85 and the surface of the soft magnetic exchange-coupled composite structure 81. The same double-sided adhesive tape 85 is also disposed on the conductive layer 83, and then an separating member 80 is disposed thereto to obtain the antenna module of FIG. 8.

An insulating film 82 is disposed on the double-sided adhesive tape 84 that is disposed between the conductive loop antenna 85 and the surface of the soft magnetic exchange-coupled composite structure 81. Therefore, the conductive loop antenna 85 may not be exposed inside an electronic device.

The conductive layer 83 may be formed as follows. Conductive paint is applied throughout one surface of the soft magnetic exchange-coupled composite structure 81, and then dried in the air at room temperature or a temperature up to 100° C. for 30 minutes to 3 hours. The conductive paint may be a product obtained by dispersing a copper or silver powder as conductive filler in an organic solvent such as butyl acetate and toluene, an acrylic resin, and an epoxy resin.

According to a method known in the art to resonate the obtained antenna module in a wanted frequency, a condenser may be inserted in a loop in parallel, and a resonance frequency is adjusted to the desired range. After that, the antenna module applicable in near metal members of various electronic devices may have very small changes in characteristics of the antenna, and accordingly may secure stable communication.

According to example embodiments, there is provided a magnetoresistive device using a soft magnetic exchange-coupled composite structure according to example embodiments.

Figure 9A:
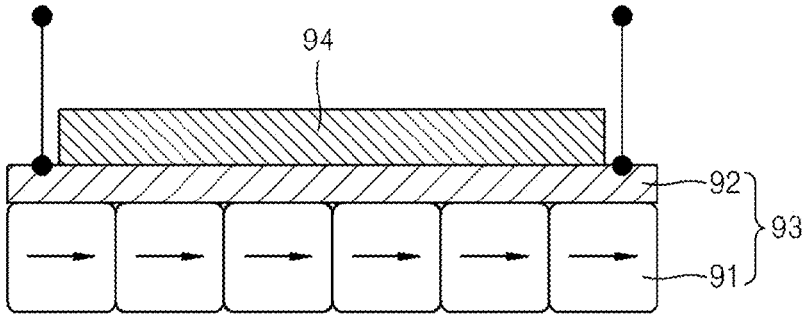
FIGS. 9A and 9B are schematic views illustrating a structure of a magnetoresistive device using a soft magnetic exchange-coupled composite structure according to example embodiments.
Figure 9B:
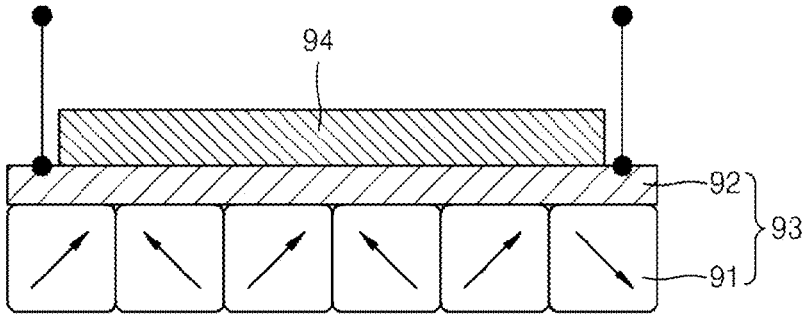

FIGS. 9A and 9B are schematic views illustrating structures of magnetoresistive devices using soft magnetic exchange-coupled composite structures according to example embodiments. FIG. 9A illustrates a magnetoresistive device when a magnetic field is applied thereto, and FIG. 9B illustrates a magnetoresistive device when a magnetic field is not applied thereto.

Referring to FIG. 9A, when an external magnetic field H is applied to a ferrite crystal grain thin film 91 of a soft magnetic exchange-coupled composite structure 93 in a magnetoresistive device, a magnetization direction of a soft magnetic metal thin film 92 is aligned. When the magnetization direction of the soft magnetic metal thin film 92 is parallel to that of the ferrite crystal grain thin film 91, electrons of the soft magnetic metal thin film 92 may have the same spin direction as electrons of the ferrite crystal grain thin film 91, and may perform electrical conduction with low resistance. On the contrary, when a magnetic field is not applied to a magnetoresistive device, the spin direction of electrons of the soft magnetic metal thin film 92 and the ferrite crystal grain thin film 91 may be randomly orientated by a generation of a magnetic domain. Then, electrical resistance among the electrons may be increased due to scattering of the electron spins. Electrons flowing through the soft magnetic metal thin film 91 according to magnetization status of the soft magnetic metal thin film 92 and the ferrite crystal grain thin film 91 that are dependent upon the external magnetic field may be scattered in a spin-dependent way. As a result, differences in electrical resistance or potential differences induced between the ferrite crystal grain thin film 91 and the soft magnetic metal thin film 92 may be occurred. When the differences are recognized as digital signals, the magnetoresistive device may detect magnetic components of a sample, and accordingly may be applicable in a magnetic resistance sensor.

Figure 10:
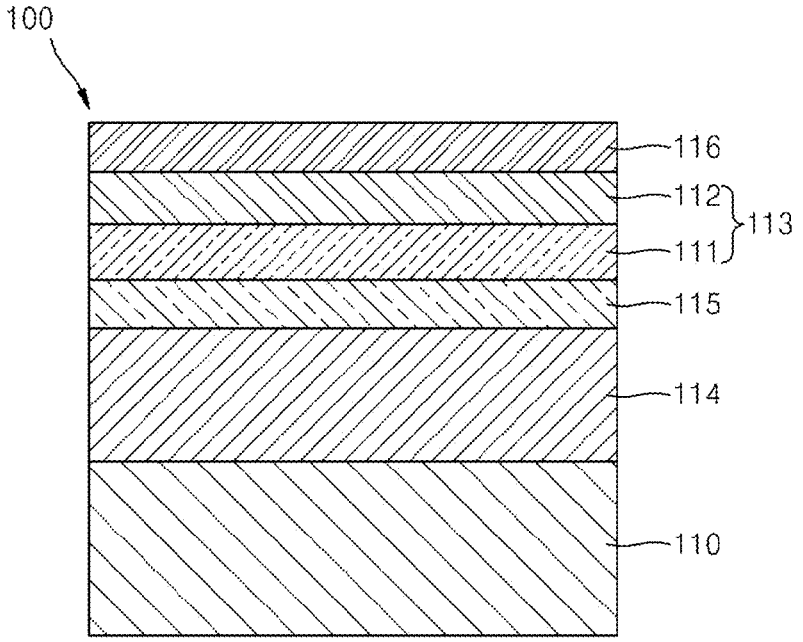

FIG. 10 is a cross-sectional view schematically illustrating a structure of a perpendicular magnetic recording medium using a hard magnetic exchange-coupled composite structure according to example embodiments.

Referring to FIG. 10, a perpendicular magnetic recording medium 100 includes a substrate 110, a soft magnetic underlayer 114, an intermediate layer 115, a recording layer 113, and a protective layer 116, which are sequentially stacked.

The recording layer 113 as a magnetic recording layer is formed using any of the hard magnetic exchange-coupled composite structures according to the above-described example embodiments. The recording layer 113 includes a ferrite crystal grain thin film 111 and a soft magnetic metal-thin film 112. In some embodiments of the present invention, the ferrite crystal grain thin film 111 and the soft magnetic metal-thin film 112 may be stacked in a reverse order. Although FIG. 10 illustrates an embodiment in which the ferrite crystal grain thin film 111 and the soft magnetic metal-thin film 112 are each stacked as a separate single layer, the ferrite crystal grain thin film 111 and the soft magnetic metal-thin film 112 may each be formed as multiple layers if needed.

The soft magnetic layer 114 may be a control layer with a single- or multi-layer structure for forming a perpendicular magnetic path on the recording layer 113 by pulling a magnetic field generated by a record head during magnetic recording. Any material used for soft magnetic layers of general perpendicular magnetic recording media may be used for the soft magnetic layer 114. For example, a soft magnetic material having a Co-based amorphous structure, or a soft magnetic material including Fe or Ni, may be used as the material for soft magnetic layers.

A seed layer (not shown) including Ta or Ta alloys may be disposed between the substrate 110 and the soft magnetic layer 114 to grow the soft magnetic layer 114. In addition, a buffer layer or a magnetic domain control layer may be further disposed between the substrate 100 and the soft magnetic layer 114. Such configurations are already well-known in the art, and thus a detailed description thereof will be omitted.

The intermediate layer 115 may be disposed underneath the recording layer 113 to improve crystallographic orientation and magnetic characteristics of the recording layer 113. The intermediate layer 115 may be selected according to a material and a crystal structure of the recording layer 113. For example, the intermediate layer 115 may be formed in a single layer, or multiple layers, including alloys of Ru, Ru oxide, MgO, and/or Ni.

The protective layer 116 for protecting the recording layer 113 from the outside may include a diamond-like-carbon (DLC) protective layer and a lubricant layer. The DLC protective layer may be formed by depositing DLC to increase surface hardness of the perpendicular magnetic recording medium 100.

The lubricant layer may include a tetraol lubricant, and may reduce abrasion of a magnetic head and the DLC protective layer caused by collision with the head and sliding of the head.

In regard to a magnetic recording method of the perpendicular magnetic recording medium, the recording head releases a recording field corresponding to given information, to a perpendicular magnetic recording medium.

Hereinafter, one or more example embodiments will be described in detail with reference to the following examples. However, these examples are not intended to limit the scope of the example embodiments.

Comparative Example 1

Manufacture of a Structure $SrCO_3$ and $Fe_2O_3$ source material powder were weighed in a mole ratio of Sr to Fe of 1:11.5 to form a disk-shaped sintered body target having a diameter of about 2 inches.

A pulsed laser deposition (PLD) process was performed using the sintered body to deposit an M-type Sr ferrite ($SrFe_{16}O_{19}$, hereinafter referred to as a SrM) on a $Si/SiO_2$ substrate. Next, the resulting structure was thermally treated in the air at a temperature of 970° C. to form a SrM thin film having a thickness of about 100 nm on the $Si/SiO_2$ substrate, thereby forming a $Si/SiO_2/SrM$ (having a thickness of about 100 nm) structure.

During the PLD process, a distance between the target and the $Si/SiO_2$ substrate was about 7 cm, and a laser energy density was about 2 J/cm$^2$. The PLD process was performed in an oxygen atmosphere at about 50 mTorr and a vacuum pressure condition of about $6\times10^{-6}$ Torr. The temperature of the substrate was controlled to a temperature of about 400° C.

Then, iron (Fe) was deposited on the $Si/SiO_2/SrM$ structure to a thickness of 10 nm by DC sputtering under vacuum conditions.

The DC sputtering conditions were as follows. The substrate temperature was room temperature, the distance between the target and the substrate was about 20 cm, the DC sputtering power was 30 W, and the base pressure was about $2\times10^{-6}$ Torr, and an inert gas atmosphere was created using argon gas at about 50 mTorr.

Still in the vacuum state, titanium (Ti) was sputtered against the Fe thin film to form a Ti capping layer having a thickness of 50 nm, thereby manufacturing a structure including the $Si/SiO_2$ substrate, the SrM thin film (having a thickness of 100 nm), the Fe thin film (having a thickness of 10 nm), and the Ti capping layer.

Comparative Example 2

Manufacture of a Structure $SrCO_3$ and $Fe_2O_3$ source material powder were weighed in a mole ratio of Sr to Fe of 1:11.5 to form a disk-shaped sintered body target having a diameter of about 2 inches.

A PLD process was performed using the sintered body to deposit a SrM ferrite on a $Si/SiO_2$ substrate. Next, the resulting structure was thermally treated in the air at a temperature of 970° C. to form a SrM thin film having a thickness of about 80 nm on the $Si/SiO_2$ substrate, thereby forming a structure including $Si/SiO_2$ substrate, and the SrM thin film having a thickness of about 80 nm.

Comparative Example 3

Manufacture of a Structure

Fe was vacuum-deposited on a $Si/SiO_2$ structure in which Si and $SiO_2$ were sequentially stacked by sputtering method at room temperature (about 25° C.), and a Fe thin film was disposed thereto to form a structure including the $Si/SiO_2$ substrate and the Fe thin film having a thickness of about 2 nm.

Comparative Example 4

Manufacture of a Structure

A structure including the $Si/SiO_2$ substrate and the Fe thin film having a thickness of 3 nm was obtained in the same manner as Example 3, except that the Fe thin film was deposited to a thickness of 3 nm.

Comparative Example 5

Manufacture of a Structure

A structure including the $Si/SiO_2$ substrate and the Fe thin film having a thickness of 4 nm was obtained in the same manner as Example 3, except that the Fe thin film was deposited to a thickness of 4 nm.

Comparative Example 6

Manufacture of a Structure

A structure including the $Si/SiO_2$ substrate and the Fe thin film having a thickness of 10 nm was obtained in the same manner as Example 3, except that the Fe thin film was deposited to a thickness of 10 nm.

Example 1

Manufacture of a Soft Magnetic Exchange-Coupled Composite Structure

The structure of Comparative Example 1 including the $Si/SiO_2$ substrate, the SrM thin film (having a thickness of 100 nm), the Fe thin film (having a thickness of 10 nm), and a Ti cap layer (having a thickness of 50 nm) was thermally treated under vacuum at a pressure of $1\times10^{-6}$ Torr and a temperature of about 300° C. for 1 hour to form a soft magnetic exchange-coupled composite structure including the $Si/SiO_2$ substrate, the SrM thin film (having a thickness of 100 nm), the Fe thin film (having a thickness of 10 nm), and the Ti cap layer (having a thickness of 50 nm).

Example 2

Manufacture of a Soft Magnetic Exchange-Coupled Composite Structure

Fe was deposited on the composite structure of Comparative Example 2 including the $Si/SiO_2$ substrate and the SrM thin film by sputtering in a vacuum condition to form the Fe thin film having a thickness of 2 nm. Next, the resulting structure was thermally treated in vacuum at a pressure of $1\times10^{-6}$ Torr and a temperature of about 300° C. to form a soft magnetic exchange-coupled composite structure including the $Si/SiO_2$ substrate, the SrM thin film (having a thickness of 80 nm), and the Fe thin film (having a thickness of 2 nm).

Example 3

Manufacture of a Soft Magnetic Exchange-Coupled Composite Structure

A soft magnetic exchange-coupled composite structure including the $Si/SiO_2$ substrate, the SrM thin film (having a thickness of 60 nm), the Fe thin film (having a thickness of 2 nm), and the Ti cap layer (having a thickness of 50 nm) was obtained in the same manner as Example 1, except that the SrM thin film was deposited to a thickness of 60 nm and the Fe thin film was deposited to a thickness of 2 nm.

Example 4

Manufacture of a Soft Magnetic Exchange-Coupled Composite Structure

A soft magnetic exchange-coupled composite structure including the $Si/SiO_2$ substrate, the SrM thin film (having a thickness of 60 nm), the Fe thin film (having a thickness of 3 nm), and the Ti cap layer (having a thickness of 50 nm) was obtained in the same manner as Example 1, except that the SrM thin film was deposited to a thickness of 60 nm and the Fe thin film was deposited to a thickness of 3 nm.

Example 5

Manufacture of a Soft Magnetic Exchange-Coupled Composite Structure

A soft magnetic exchange-coupled composite structure including the $Si/SiO_2$ substrate, the SrM thin film (having a thickness of 60 nm), the Fe thin film (having a thickness of 4 nm), and the Ti cap layer (having a thickness of 50 nm) was obtained in the same manner as Example 1, except that the SrM thin film was deposited to a thickness of 60 nm and the Fe thin film was deposited to a thickness of 4 nm.

Example 6

Manufacture of a Soft Magnetic Exchange-Coupled Composite Structure $SrCO_3$ and $Fe_2O_3$ source material powder were weighed in a mole ratio of Sr to Fe of 1:11.5 to form a disk-shaped sintered body target having a diameter of about 2 inches.

A PLD process was performed using the sintered body to deposit a SrM ferrite on a $Si/SiO_2$ substrate. Next, the resulting structure was thermally treated in the air at a temperature of 970° C. to form a SrM thin film having a thickness of about 80 nm on the $Si/SiO_2$ substrate, thereby forming a $Si/SiO_2$/SrM (having a thickness of about 80 nm) structure.

During the PLD process, a distance between the target and the $Si/SiO_2$ substrate was about 7 cm, and a laser energy density was about 2 $J/cm^2$. The PLD process was performed in an oxygen atmosphere at about 50 mTorr and a vacuum pressure condition of about $6\times10^{-6}$ Torr. The temperature of the substrate was controlled to a temperature of about 400° C.

Then, Fe was deposited on the $Si/SiO_2$/SrM structure to a thickness of 2 nm by DC sputtering method under vacuum conditions at room temperature (about 25° C.). Still in the vacuum state, Ti was deposited to form a Ti capping layer having a thickness of 50 nm, thereby obtaining a soft magnetic exchange-coupled composite structure including the $Si/SiO_2$ substrate, the SrM thin film (having a thickness of 80 nm), the Fe thin film (having a thickness of 2 nm), and the Ti capping layer (having a thickness of 50 nm).

The DC sputtering conditions were as follows. The substrate temperature was room temperature, the distance between the target and the substrate was about 20 cm, the DC sputtering power was 30 W, and the base pressure was about $2\times10^{-6}$ Torr in an argon gas atmosphere at about 50 mTorr.

The composite structure including the $Si/SiO_2$ substrate, the SrM thin film (having a thickness of 80 nm), the Fe thin film (having a thickness of 20 nm), and the Ti capping layer was thermally treated in vacuum at a temperature of 350° C. for 1 hour and a vacuum pressure of $1\times10^{-6}$ Torr to form a soft magnetic exchange-coupled composite structure including the $Si/SiO_2$ substrate, the SrM thin film (having a thickness of 80 nm), the Fe thin film (having a thickness of 20 nm), and the Ti capping layer having a thickness of 50 nm.

Reference Example 1

Manufacture of a Structure

A structure including the $Si/SiO_2$ substrate, the SrM thin film (having a thickness of 80 nm), the Fe thin film (having a thickness of 2 nm), and the Ti capping layer (having a thickness of 50 nm) was obtained in the same manner as Example 6, except that the thermal treatment was not performed at a pressure of $1\times10^{-6}$ Torr and a temperature of about 350° C. for 1 hour in regard to the structure.

The thicknesses of the SrM thin films and the Fe thin films in the soft magnetic exchange-coupled composite structures of Examples 1 to 6 and in the structure of Comparative Examples 1 to 6 and Reference Example 1 are shown in Table 1 below. Performance of the thermal treatment in a vacuum and temperature conditions thereof are also shown in Table 1 below.

TABLE 1

| Examples | Thickness of SrM thin film (nm) | Thickness of Fe thin film (nm) | Conditions of thermal treatment after forming a $Si/SiO_2/SrM/Fe/Ti$ structure: Performance of thermal treatment | Temperature of thermal treatment | Thickness ratio of SrM thin film to Fe thin film |
|---|---|---|---|---|---|
| Example 1 | 100 | 10 | X (no performance of vacuum heat treatment) | | 10:1 |
| Example 2 | 80 | 2 | ○ | 300 | 40:1 |
| Example 3 | 60 | 2 | ○ | 300 | 30:1 |
| Example 4 | 60 | 3 | ○ | 300 | 20:1 |
| Example 5 | 60 | 4 | ○ | 300 | 15:1 |
| Example 6 | 80 | 20 | ○ | 350 | 4:1 |
| Comparative Example 1 | 100 | 10 | X | | 10:1 |
| Comparative Example 2 | 80 | X | X | | — |
| Comparative Example 3 | X | 2 | X | | — |
| Comparative Example 4 | X | 3 | X | | — |
| Comparative Example 5 | X | 4 | X | | — |
| Comparative Example 6 | X | 10 | X | | — |
| Reference Example 1 | 80 | 2 | X | | 40:1 |

Evaluation Example 1

Measurement of Saturation Magnetization (Ms) and Coercivity

1) Example 1 and Comparative Example 1

Magnetization characteristics of the soft magnetic exchange-coupled composite structure of Example 1 and the composite structure of Comparative Example 1 were evaluated. The results are shown in FIG. 11.

Figure 11:
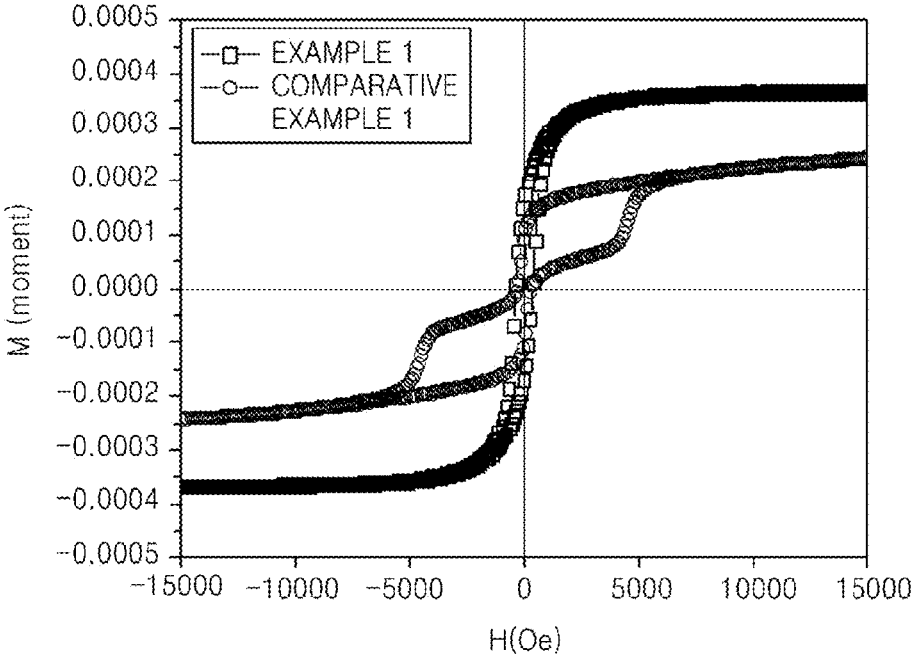

Referring to FIG. 11, in the structure of Comparative Example 1, Fe in the interface between the SrM thin film and the Fe thin film was found to be in an amorphous-like condition due to a low crystalline. The structure of Comparative Example 1 also shows characteristics of double hysteresis, the double hysteresis formed by overlapping each hysteresis of the SrM thin film and Fe thin film.

On the contrary, in the soft magnetic exchange-coupled composite structure of Example 1, crystallinity of the interface between the SrM thin film and the Fe thin film was found to be improved, and the SrM thin film has undergone soft magnetization by the Fe thin film. Thus, the composite structure of Example 1 shows characteristics of one hysteresis and has an increased saturation magnetization (Ms) value with a significantly reduced hysteresis area.

1) Examples 2 and 6, and Comparative Example 2

Magnetization characteristics of the soft magnetic exchange-coupled composite structures of Examples 2 and 3 and the composite structure of Comparative Example 2 were evaluated. The results are shown in FIG. 12.

Figure 12:
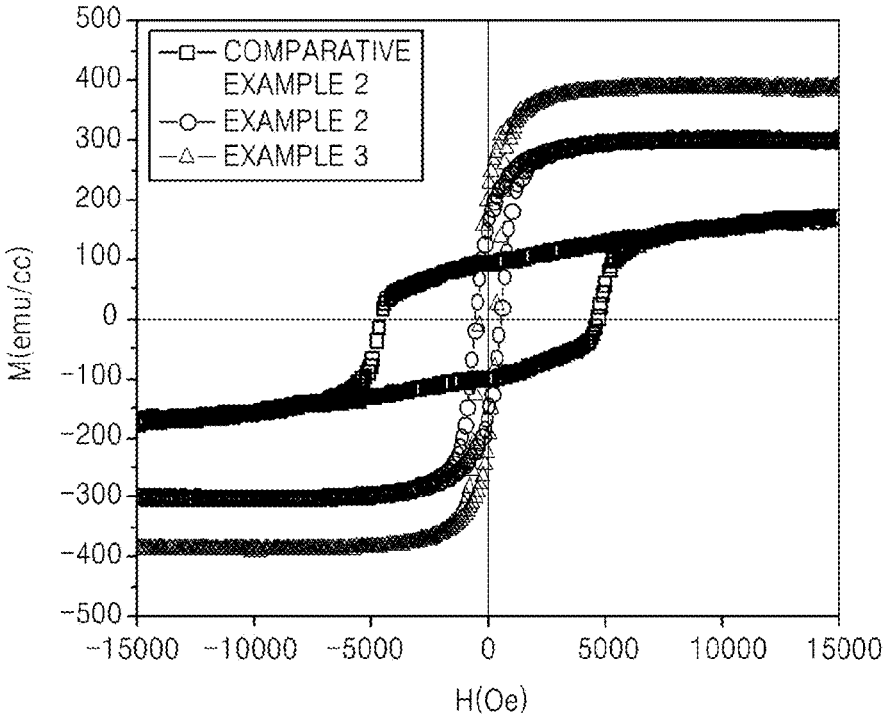

Referring to FIG. 12, the soft magnetic exchange-coupled composite structures of Examples 2 and 3 has undergone soft magnetization of the SrM thin film, and thus may have a significantly decreased coercivity with an increased Ms value, compared to the composite structure of Comparative Example 2.

1) Examples 3 to 5, and Comparative Examples 3 to 6

Magnetization characteristics of the soft magnetic exchange-coupled composite structures of Examples 3-5 and the composite structures of Comparative Examples 3 to 6 were evaluated. The results are shown in FIGS. 16A and 16B.

Figure 16A:
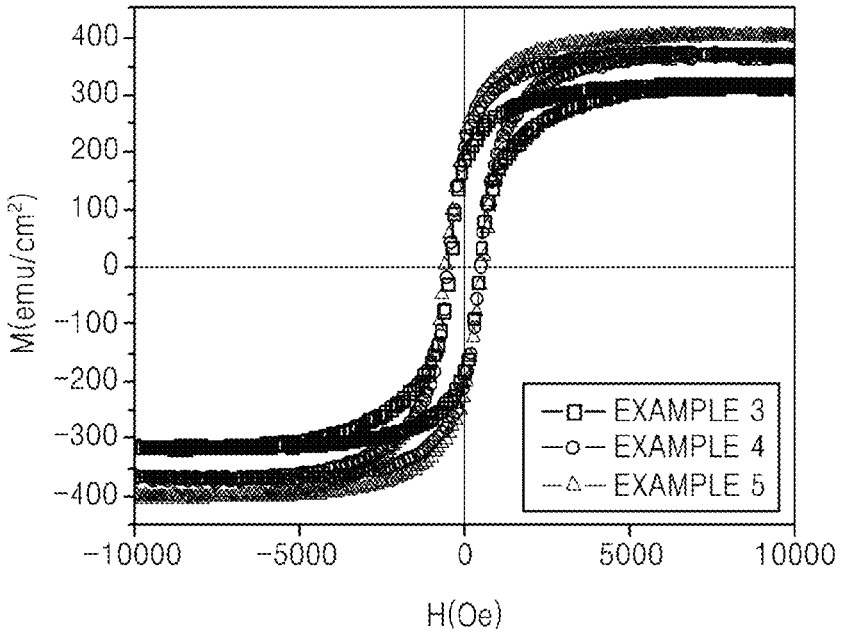
FIG. 16A is a graph showing magnetization characteristics of soft magnetic exchange-coupled composite structures of Examples 3 to 5.
Figure 16B:
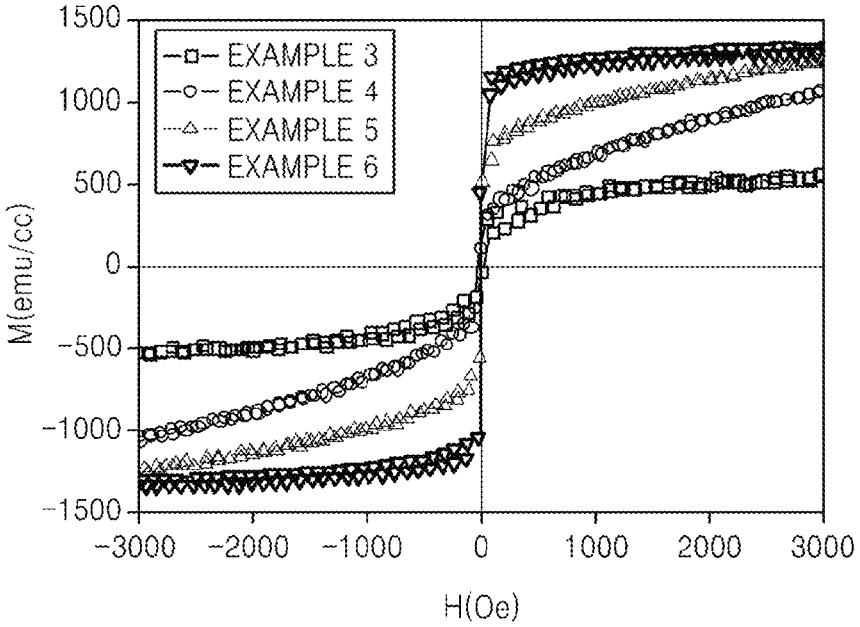
FIG. 16B is a graph showing magnetization characteristics of structures of Comparative Examples 3 to 6.

Referring to FIGS. 16A and 16B, the soft magnetic exchange-coupled composite structures of Examples 3 to 5 were found to have increased Ms values with decreased coercivity, compared to the composite structures of Comparative Examples 3 to 6. That is, soft magnetization may have occurred.

Evaluation Example 2

TEM Analysis

The soft magnetic exchange-coupled composite structure of Example 1 and the structure Comparative Example 1 were evaluated by analysis of transmission electron microscopy (TEM). The results are shown in FIGS. 13A, 13B, and 14.

An analyzer Tecnai Titan manufactured by FEI Company was used for the TEM analysis.

Figure 13A:
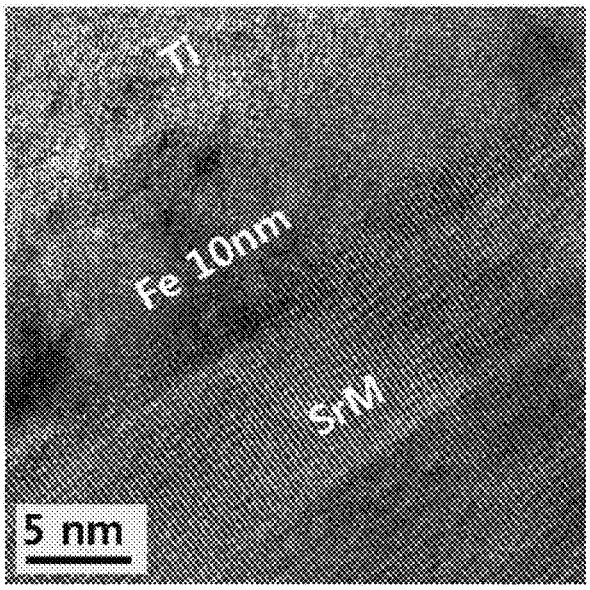
FIGS. 13A and 13B are transmission electron microscope (TEM) images showing analysis results of the soft magnetic exchange-coupled composite structure of Example 1.
Figure 14:
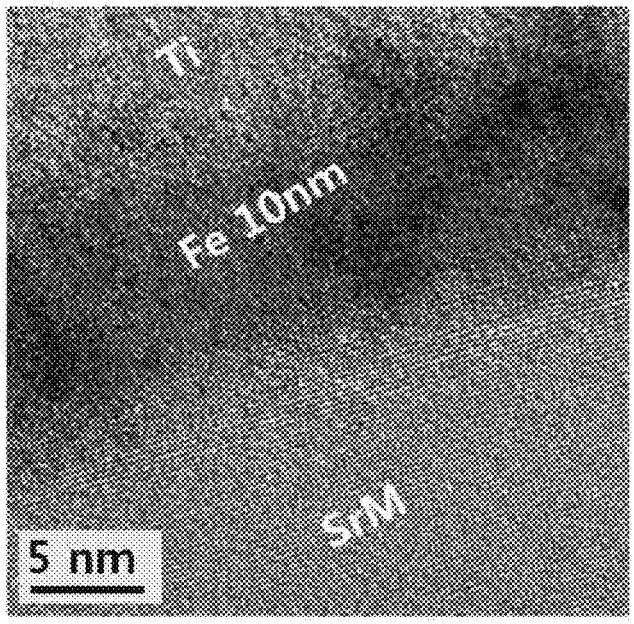

Referring to FIG. 13A, because Fe as the soft magnetic metal was re-orientated by thermal treatment in a vacuum, the soft magnetic exchange-coupled composite structure of Example 1 was found to include Fe and SrM bonded to the Fe by interfacial bonding on an atomic scale, wherein the Fe in a region adjacent to the interface with the SrM is in a crystalline state.

Figure 13B:
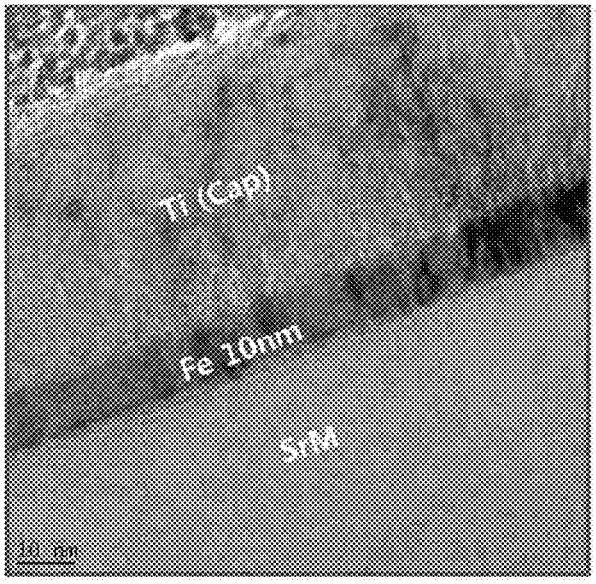

FIG. 13B is a high-resolution TEM image showing an interfacial bonding region on atomic scale between SrM and Fe thin films in the soft magnetic exchange-coupled structure. Here, it was confirmed that a thickness of the Fe thin film is about 10 nm.

The structure of Comparative Example 1 was a structure prepared before performing thermal treatment in a vacuum to the composite structure of Example 1.

Referring to FIG. 14, the Fe thin film in a region adjacent to the SrM thin film was found to be in an amorphous state with low crystallinity.

The composite structures of Examples 2 to 6 and the structures of Comparative Examples 3 to 6 and Reference Example 1 were evaluated by TEM to analyze crystallinity of the Fe thin films.

As a result, the Fe thin films in the composite structures of Examples 2 to 6 were found to be in a crystalline state, whereas the Fe thin films in the composite structures of Comparative Examples 3 to 6 and Reference Example 1 were found to be in an amorphous state.

Evaluation Example 3

Thermal Stability

The soft magnetic exchange-coupled composite structures of Examples 2 and 6 and the structure of Comparative Example 2 were evaluated to measure each hysteresis at temperatures of 5 K, 77 K, 150 K, 225 K, 300 K, and 350 K. Then, saturation magnetization values were obtained therefrom.

Figure 15:
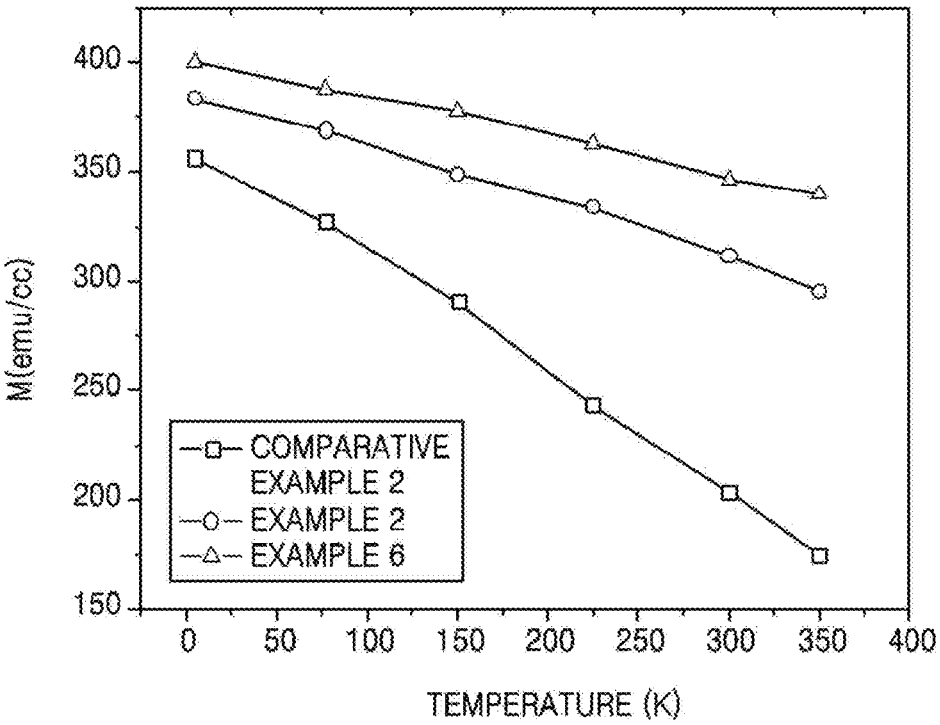

The results are shown in FIG. 15.

Referring to FIG. 15, the soft magnetic exchange-coupled composite structures of Examples 2 and 6 were found to have improved thermal stabilities of the magnetization characteristic compared to the structure of Comparative Example 2.

Evaluation Example 4

TEM-EDAX Analysis

The soft magnetic exchange-coupled composite structure of Example 6 and the structure of Reference Example 1 were evaluated by transmission electron microscopy-energy dispersive X-ray analysis (TEM-EDAX), an analyzer FEI Titan 80-300 manufactured by Philips Company was used for the TEM-EDAX analysis.

The results of the TEM-EDAX analysis are shown in FIGS. 17 to 20.

Figure 17:
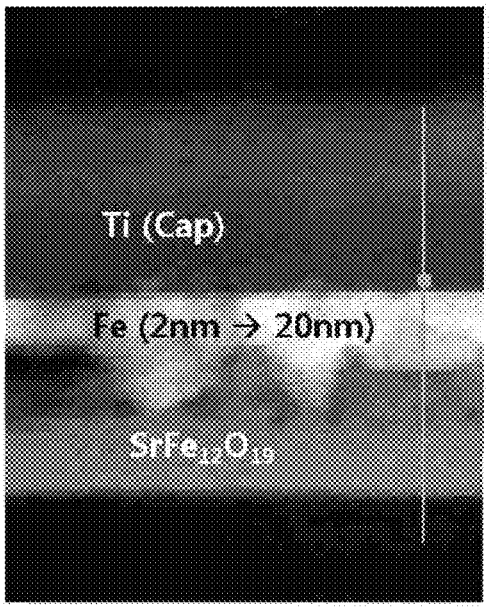
Figure 18:
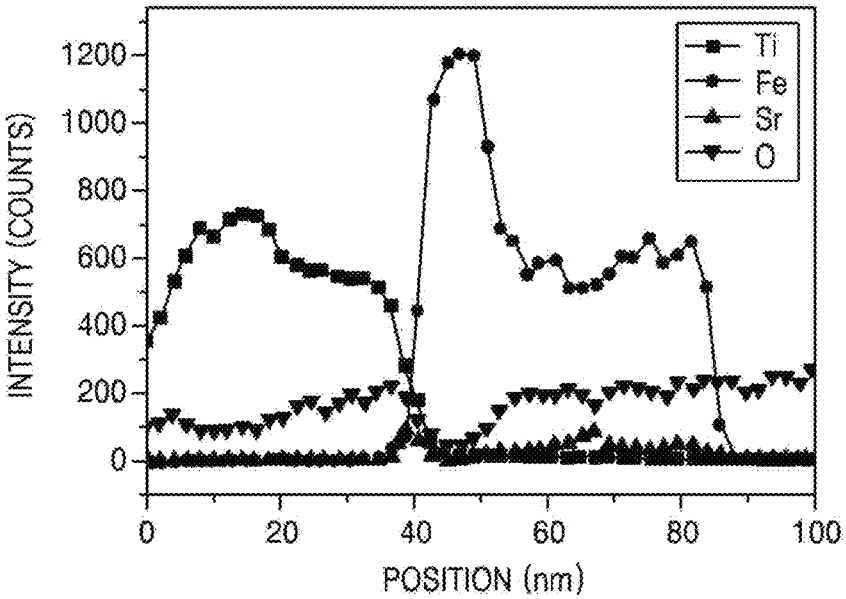
Figure 19:
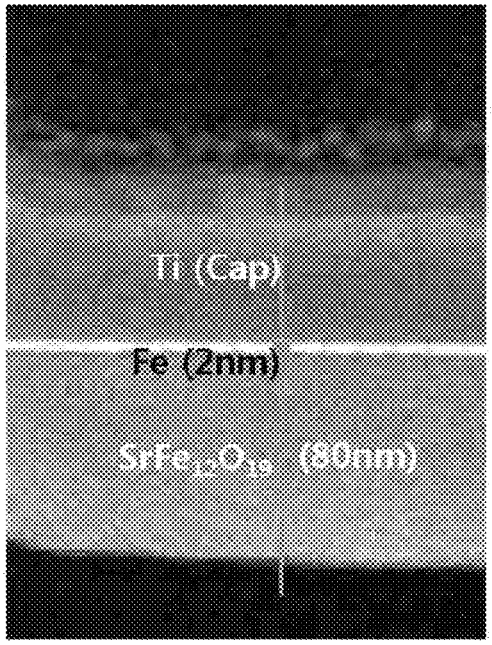
Figure 20:
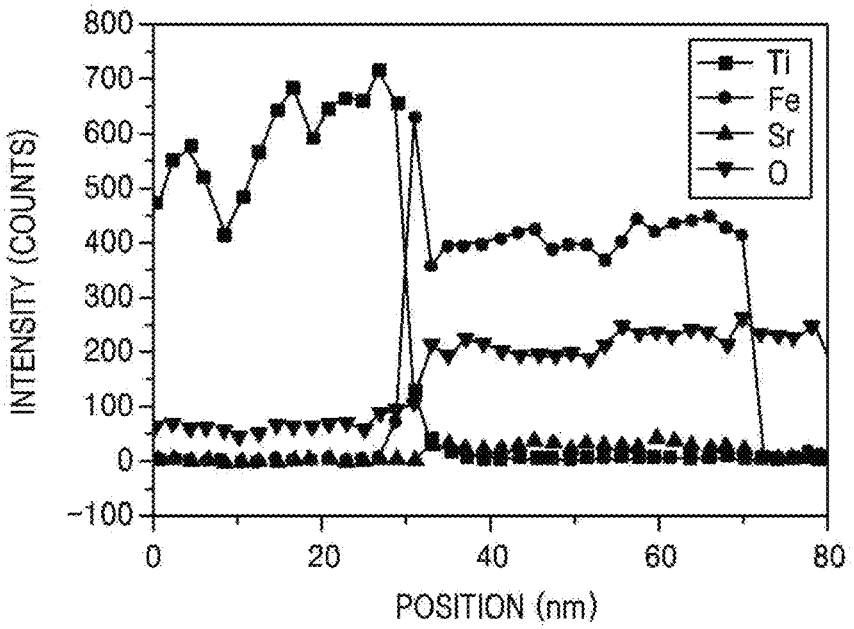

FIGS. 17 and 18 show the results of the TEM-EDAX analysis in regard to the soft magnetic exchange-coupled composite structure of Example 6. FIGS. 19 and 20 show the results of the TEM-EDAX analysis in regard to the structure of Reference Example 1.

In the soft magnetic exchange-coupled composite structure of Example 6, a thickness of the Fe thin film prior to the thermal treatment in a vacuum was 2 nm like the Fe thin film in the structure of Reference Example 1. However, after the thermal treatment in a vacuum, grains of the Fe thin film were grown, and accordingly a thickness of the Fe thin film was increased to about 20 nm (see FIG. 17). In this regard, unlike the Fe thin film in the structure of Reference Example 1 (see FIG. 20), the growth of the Fe thin film in the soft magnetic exchange-coupled composite structure of Example 6 may be confirmed by the results of the EDAX analysis as shown in FIG. 18.

As described above, according to one or more of the above example embodiments, a soft magnetic exchange-coupled composite structure has improved characteristics of saturation magnetization with decreased coercivity. The soft magnetic exchange-coupled composite structure may be applicable in components of a soft magnetic device and a high-frequency communication device, the components having high magnetic permeability and low hysteresis.

It should be understood that the example embodiments described therein should be considered in a descriptive sense only and not for purposes of limitation. Descriptions of features within each example embodiment should typically be considered as available for other similar features in other example embodiments.

What is claimed is:

1. A soft magnetic exchange-coupled composite structure, comprising:

a ferrite crystal grain as a main phase, the ferrite crystal grain having a first thin film structure, wherein the ferrite crystal grain is oxygen-deficient; and a soft magnetic metal as an auxiliary phase bonded to the ferrite crystal grain by interfacial bonding on an atomic scale, the soft magnetic metal having a second thin film structure, wherein a region of the soft magnetic metal adjacent to an interface with the ferrite crystal grain includes a crystalline soft magnetic metal, and the crystalline soft magnetic material has a third thin film structure, the third thin film structure being between the first thin film structure and the second thin film structure.

2. The soft magnetic exchange-coupled composite structure of claim 1, wherein the ferrite crystal grain is at least one selected from the group consisting of hexagonal ferrite, spinel ferrite, and garnet ferrite.

3. The soft magnetic exchange-coupled composite structure of claim 1, wherein the soft magnetic metal is at least one selected from the group consisting of iron (Fe), cobalt (Co), nickel (Ni), manganese (Mn), and an alloy thereof.

4. The soft magnetic exchange-coupled composite structure of claim 1, wherein a total thickness of the soft magnetic metal thin film bonded to the ferrite crystal grain by interfacial bonding on the atomic scale is 1 nm or greater.

5. The soft magnetic exchange-coupled composite structure of claim 1, wherein a thickness of the ferrite crystal grain is in a range of about 50 nm to about 500 nm.

6. The soft magnetic exchange-coupled composite structure of claim 1, wherein a total thickness of the soft magnetic metal is 1 nm or greater.

7. The soft magnetic exchange-coupled composite structure of claim 6, wherein a thickness of the soft magnetic metal is in a range of about 1 nm to about 30 nm.

8. The soft magnetic exchange-coupled composite structure of claim 1, further comprising:

a capping layer or a passivation layer.

9. The soft magnetic exchange-coupled composite structure of claim 8, wherein the capping layer includes at least one selected from the group consisting of tantalum (Ta), chromium (Cr), titanium (Ti), nickel (Ni), tungsten (W), ruthenium (Ru), palladium (Pd), platinum (Pt), zirconium (Zr), hafnium (Hf), silver (Ag), gold (Au), aluminum (Al), antimony (Sb), molybdenum (Mo), cobalt (Co), and tellurium (Te).

10. The soft magnetic exchange-coupled composite structure of claim 8, wherein the passivation layer includes at least one selected from the group consisting of aluminum oxide ($Al_2O_3$), magnesium oxide (MgO), titanium (Ti), aluminum (Al), and tantalum (Ta).

11. The soft magnetic exchange-coupled composite structure of claim 1, wherein the ferrite crystal grain has an M-type hexagonal ferrite crystal grain thin film structure, and the soft magnetic metal includes a Fe thin film or Fe-alloy thin film.

12. The soft magnetic exchange-coupled composite structure of claim 11, wherein a total thickness of the Fe or Fe-alloy thin films is 1 nm or greater.

13. The soft magnetic exchange-coupled composite structure of claim 11, wherein a thickness of the M-type hexagonal ferrite crystal grain thin film is in a range of about 60 nm to about 100 nm, and a thickness of the Fe or Fe-alloy thin films is in a range of about 2 nm to about 20 nm.

14. The soft magnetic exchange-coupled composite structure of claim 11, wherein the M-type hexagonal ferrite crystal grain thin film includes $SrFe_{12}O_{19}$.

15. The soft magnetic exchange-coupled composite structure of claim 11, further comprising:

a capping layer having at least one selected from the group consisting of tantalum (Ta), chromium (Cr), titanium (Ti), nickel (Ni), tungsten (W), ruthenium (Ru), palladium (Pd), platinum (Pt), zirconium (Zr), hafnium (Hf), silver (Ag), gold (Au), aluminum (Al), antimony (Sb), molybdenum (Mo), cobalt (Co), and tellurium (Te).

16. A high-frequency device component, comprising:

the soft magnetic exchange-coupled composite structure according to claim 1.

17. An antenna module, comprising:

the soft magnetic exchange-coupled composite structure according to claim 1.

18. A magnetoresistive device, comprising:

the soft magnetic exchange-coupled composite structure according to claim 1.

19. The soft magnetic exchange-coupled composite structure of claim 1, wherein the third thin film structure has a thickness in a range of about 2 nm to about 20 nm, and the second thin film structure has a thickness in a range of about 1 nm to about 30 nm.

* * * * *